US005334091A

United States Patent [19]

Shih-Chin

[11] Patent Number: 5,334,091

[45] Date of Patent: * Aug. 2, 1994

[54] WINDOW FAN

[75] Inventor: Shao Shih-Chin, Framingham, Mass.

[73] Assignee: Holmes Products Corp., Milford, Mass.

[ * ] Notice: The portion of the term of this patent subsequent to Mar. 2, 2010 has been disclaimed.

[21] Appl. No.: 950,942

[22] Filed: Sep. 24, 1992

Related U.S. Application Data

[63] Continuation of Ser. No. 693,303, May 1, 1991, Pat. No. 5,190,496.

[51] Int. Cl.[5] ..... F24F 7/013

[52] U.S. Cl. ..... 454/210; 454/244; 454/332

[58] Field of Search ..... 454/200, 202, 203, 205, 454/208, 209, 210, 244, 331, 332

[56] References Cited

U.S. PATENT DOCUMENTS

| | | | |
|---|---|---|---|
| D. 142,252 | 8/1945 | Campbell | 454/210 X |
| 1,988,810 | 1/1935 | Ross | 454/210 |
| 2,407,858 | 9/1946 | Whitefield | 454/205 |
| 2,436,344 | 2/1948 | Winogrond . | |
| 2,620,126 | 12/1952 | Lyne | 454/209 X |
| 2,620,721 | 12/1952 | Krauss | 454/209 |
| 2,787,207 | 4/1957 | Moore | 454/209 |
| 2,805,820 | 9/1957 | Evarts | 454/200 X |
| 2,846,936 | 8/1958 | Copeland | 454/210 |
| 3,680,258 | 8/1972 | Loyd | 454/203 X |
| 3,762,303 | 10/1973 | Hoffman | 454/332 |
| 3,861,283 | 1/1975 | Shaner | 454/203 |
| 4,773,310 | 9/1988 | Corwin | 454/244 |
| 4,838,151 | 6/1989 | Shin-Chin | 454/200 |
| 4,872,399 | 10/1989 | Chane | 454/210 |

*Primary Examiner*—Harold Joyce

*Attorney, Agent, or Firm*—Kriegsman & Kriegsman

[57] ABSTRACT

A window fan which can be mounted in a window opening in either a double-hung window frame or a vertical slider window frame and which can be held securely in place without the use of additional hardware or mounting brackets. The window fan comprises a housing of generally rectangular shape, the housing including a front piece, a back piece, and a pair of side extensions. The side extensions have outer edges sized and shaped to fit within the left and right side railings of a double-hung window or the top and bottom railings of a vertical slider window. Each one of the side extensions includes a pair of outer guides and a plurality of panels telescopically mounted within the outer guides. The side extensions extend out from the sides of the housing at about the rear edge so as to permit installation in windows having outer screens. A plurality of locking mechanisms are provided which, when in the closed position, keep the extenders locked at a desired extension and which, when in the open position, permit a ratchet-type extension or compression of the extenders. A pair of fan units are disposed within the housing in front of the back piece, the fan units having electrically reversible motors which are independently controllable so that either both fans can be used to intake air or to exhaust air or so that one fan unit be used to intake air while the other fan unit is being used to exhaust air.

5 Claims, 5 Drawing Sheets

WINDOW FAN

This is a continuation of application Ser. No. 07/693,303, filed May 1, 1991 U.S. Pat. No. 5,190,496.

BACKGROUND OF THE INVENTION

The present invention relates generally to fans and more particularly to window fans.

In U.S. Pat. No. 4,872,399, there is disclosed an electric fan assembly for household use convertible between use in a window and use on a desk or floor. The fan assembly includes a substantially rectangular, one-piece, molded polypropylene support member formed from a first support panel, a second support panel, and a pair of living hinges connecting the first and second panels to one another along a pivot axis perpendicular to the top and bottom edges of the support member. The first support panel is constructed to provide a mounting for an electric fan motor, a venturi ring assembly including an intake grill and an exhaust grill. In use, the two support panels may lie flat for use in a window or may be pivoted about the axis of the living hinges for use on a deck or floor. Extenders are provided for extending the effective width of said fan assembly for use in relatively wide windows and includes secondary extender plates connected to the extenders by lost motion for increasing the length of extension obtainable. The exhaust grill is optionally mounted for rotation.

In U.S. Pat. No. 4,838,151, there is disclosed a fan which can be mounted in a window opening without using any tools, mounting hardware or special brackets or which can be used as floor fan. The fan includes a pair of panel sections which are Interconnected by a pair of hinge joints for pivotal movement relative to each other from a fully open position to a folded position. One of the hinge joints includes a mechanism for automatically snap-locking the two panel sections when they are at the fully open position at an angle of about 120 degrees. A pair of adjustable and lockable side extensions are provided, one attached to and extending out from each panel section. A fan unit which includes a motor driven fan is pivotally attached to the panel sections for rotational movement relative thereto.

In U.S. Pat. No. 4,341,151, there is disclosed an electric fan which can serve as a table fan, a circulator, a wall fan or a window fan. The fan comprises a motor to retain and drive vanes, an annular main body to retain the motor and to serve as an air flow passage of the fan, a pair of pivots which are provided on the main body, have their axes on a phantom straight line substantially perpendicular to the axis of rotation of the vanes and are symmetrical with respect to said axis of rotation, and a pair of support plates which are rotatably connected with each other and with the main body by means of the pivots, the support plates being of a shape which surrounds the main body and does not hinder the movement of the main body on the pivots.

In U.S. Pat. No. 4,222,318, there is disclosed a fan which can be used either as a floor fan or a window fan. The fan includes an open frame having a motor driven fan connected to the rear portion thereof, a pair of protruding pins on the frame front portion which engage the window on the outside thereof, and a second pair of protruding pins on the frame front portion which engage the window frame on the inside thereof. The motor driven fan is suspended in this manner inwardly away from the window opening such that the cantilever effect produced thereby pulls the first pins inwardly against the window and pushes the second pins outwardly against the window frame. The frame of the fan diverges slightly in the vertical direction so that that it is, in effect, wedged into the window opening and makes it more difficult to remove accidentally and strengthens the frame. The unit is easily adapted for use with a horizontally sliding window by attaching a pair of removable laterally extending brackets.

In U.S. Pat. No. 2,857,095, there is disclosed an all-purpose fan embodying in combination an air flow generating unit comprising a motor with coaxial shaft and rotary air impeller, a skeletonized framework united with and supporting said unit, an outer bail straddling said framework and pivotally connected thereto to swing about an axis of tilt disposed crosswise the axis of rotation of said air impeller, a swingable inner ball also straddling said framework and pivotally connected thereto and also pivotally connected to said outer bail in a manner to be swingable toward and away from planar alignment therewith, detent devices operatively relating one of said bails to said framework in a manner releasably to retain the same in various relative angular positions to which said bail and framework may be swung, stop means so operatively relating said bails as to limit the degree of divergence thereof from said approximately planar alignment, and at least one hinge lug fixed on a portion of said outer bail relatively remote from said framework and having means of pivotal mounting offset from said outer bail.

In U.S. Pat. No. 2,733,002, there is disclosed a fan structure having a pair of fan units which can either be mounted in an opening in a window in vertical tandem relationship or in horizontal tandem relationship or used separately as floor fans. When mounted in a window opening with the fan units in horizontal tandem relationship, the fan is secured in position by clamping engagement of the fan housing with the lower edge of the window and the window sill. When mounted in vertical tandem relationship, the fan is secured in position by brackets which are screwed into the window frame.

In U.S. Pat. No. 2,715,495, there is disclosed a window ventilator which comprises an upright shield having an aperture therein, supporting structure extending outwardly from said shield below said aperture, a fan structure including a propeller guard, a fan motor secured to said guard, and a propeller carried within said guard and rotatable by said motor, said fan structure being positioned substantially in line with said aperture, means on and supported by said transparent shield providing rotary bearing means, and cooperating rotary bearing means on said fan structure for pivotally mounting said fan structure at a predetermined distance from said shield, said fan structure being pivotal about said pivotal mounting means to direct an air stream in any of a plurality of predetermined directions.

In U.S. Pat. No. 2,580,663, there is disclosed a variable-width window fan assembly which comprises a window fan and driving motor together with a supporting frame which will usually but not necessarily consist of a housing or casing about the fan and motor, together with one or more horizontally adjustable, normally vertically disposed panel or wing elements slidably connected to the frame, and a simplified two-link toggle mechanism the elements of which are operatively connected to the one or more adjustable wings, and with which is provided a simple form of clamping means for maintaining the links or arms of the toggle assembly, in centered or aligned relation following the desired width adjustment.

In U.S. Pat. No. 2,529,040, there is disclosed a fan which is adapted to be mounted within the space normally occupied by the lower sash of an ordinary two sash window. The fan includes a rigid rectangular frame which is fixed in size and shape. In use, the frame is seated on the sill of the window and then anchored to the casing of the window by a pair of tie rods, the tie rods being hooked on to the frame of the fan and being secured by screws to the casing of the window.

Other patents of interest include U.S. Pat. Nos. 3,019,718, 2,805,820, and 2,787,207 and Australian Patent No. 235,520.

SUMMARY OF THE INVENTION

It is an object of the of the invention to provide a new and improved window fan.

It is another object of the invention to provide a window fan that can be securely and removably mounted within a window opening without requiring any tools, special brackets, or mounting hardware.

It is still another object of the invention to provide a window fan that can be used with either double-hung windows or vertical slider windows.

It is still yet another object of the invention to provide a window fan that can be mounted within window openings varying in width or length.

It is a further object of the invention to provide a window fan that can be mounted in a window having an outer screen without hitting up against the outer screen.

It is still a further object of the invention to provide a window fan that is constructed to provide improved circulation of air.

It is still yet another object of the invention to provide a window fan having a grille that can easily be removed and remounted to permit cleaning of the fan blades.

Additional objects of the invention, as well as features and advantages thereof, will be set forth in part in the description which follows, and in part will be obvious from the description or may be learned by practice of the invention. The objects of the invention also may be realized and attained by means of the instrumentalities and combinations particularly pointed out in the appended claims.

According to one feature of the invention, the window fan comprises a pair of fan units, each fan unit including a set of fan blades driven by a reversible electric motor, the direction of rotation of each reversible electric motor being separately controllable so that one set of fan blades can be driven to pull fresh air into the room while, at the same time, the other set of fan blades can be driven to exhaust stale air out of the room.

According to another feature of the invention, the window fan comprises a housing including a substantially flat back wall and a pair of side extensions, the side extensions extending out from the sides of the housing proximate to the back wall so that when the window fan is mounted in a window having an outer screen, the back surface of the window fan does not come into contact with the outer screen.

According to yet another feature of the invention, the side extensions are provided with a unique construction, each side extension being adjustably extendable and lockable at any desired extension.

According to a further feature of the invention, the window fan is provided with a grille that removably snap-locks Into an opening in the housing to permit access to the fan blades mounted within the housing.

According to still a further feature of the invention, the locking mechanism for the side extensions has a unique construction.

BRIEF DESCRIPTION OF THE DRAWINGS

The accompanying drawings, which are hereby incorporated into and constitute a part of this specification, illustrate the preferred embodiments of the invention and, together with the description, serve to explain the principles of the invention. In the drawings wherein like reference numerals represent like parts.

DETAILED DESCRIPTION OF PREFERRED EMBODIMENTS

Figure 1:
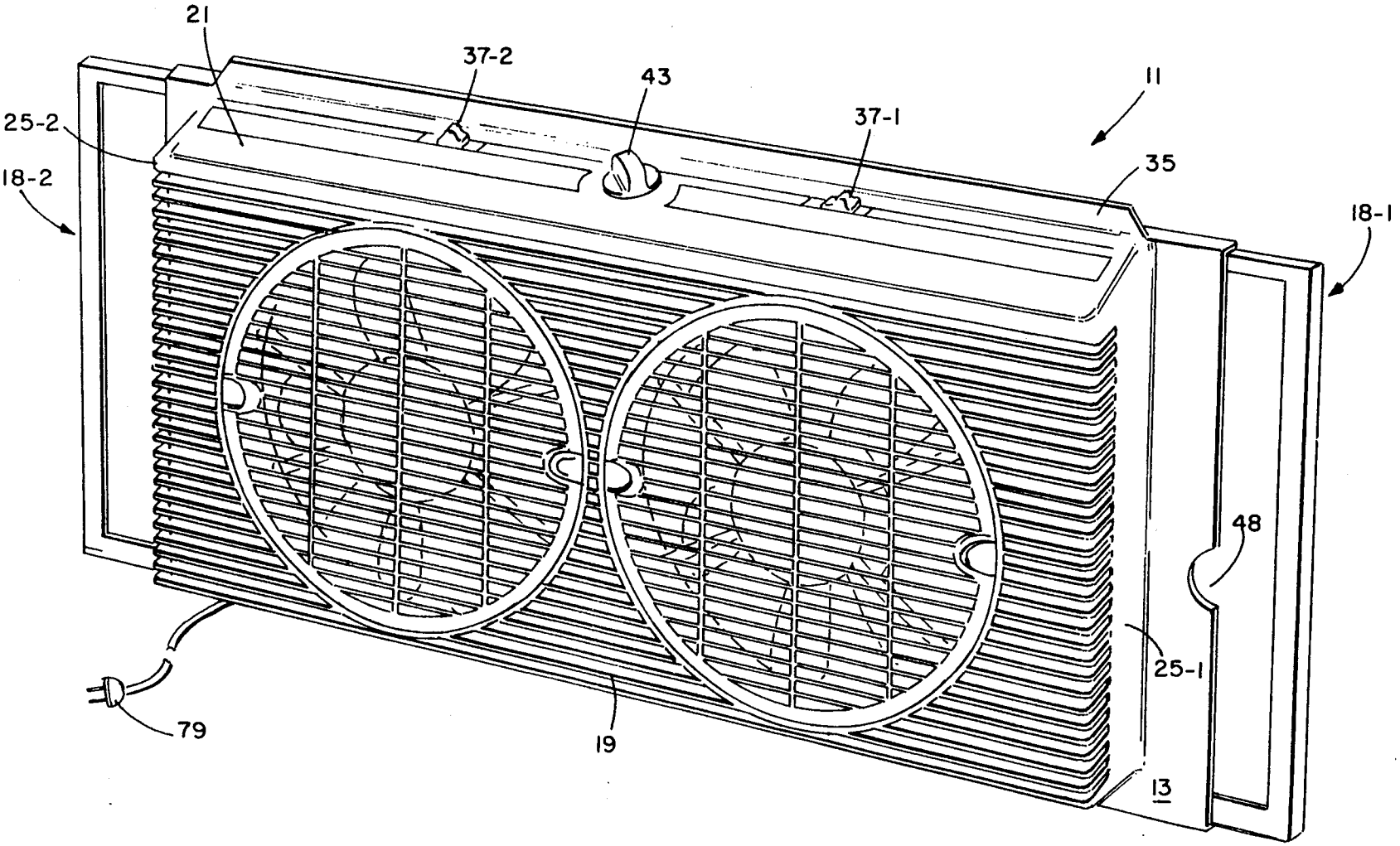
FIG. 1 is a front perspective view of one embodiment of a window fan constructed according to the teachings of the present invention.

Referring now to the drawings and specifically to FIGS. 1 through 8, there is shown one embodiment of a window fan constructed according to the teachings of the present invention and represented generally by reference numeral 11.

For simplicity, parts of window fan 11 not pertinent to the invention will not be shown or discussed.

Window fan 11 includes a substantially rectangularly-shaped housing 13 having a front piece 15, a back piece 17, and a pair of adjustable and lockable side extensions 18-1 and 18-2.

Front piece 15, which is preferably made of molded plastic, is shaped to form a cavity defined by a front wall 19, a top wall 21, a bottom wall 23, a pair of side walls 25-1 and 25-2, and an open back.

Front wall 19 is shaped to define a pair of cylindrically-shaped walls 29, each wall defining a circular opening. A circumferentially disposed shelf 31 is integrally formed on each wall 29 a short distance from its front end. As will be described below in greater detail, shelf 31 is used to snap-lock mount a louver grille 33 within the opening.

Top wall 21 includes a lip 35, which extends along the length thereof proximate to back piece 17. A pair of intake/exhaust switches 37-1 and 37-2, each of which independently controls the direction of rotation of a corresponding reversible fan motor disposed within the cavity of housing 13, are mounted on top wall 21. In addition, a three setting (off-high-low) power switch 43, which is connected to both of the aforementioned fan motors, is also mounted on top wall 21.

A self-sticking, foam-rubber strip 45 having a removable paper backing (not shown) is adhered to the bottom surface of housing 13. As will become apparent from the description below, strip 45 is useful in securing window fan 11 to the window sill of a double-hung window.

Back piece 17, which is made of molded plastic, is fixedly mounted onto the rear surface of front piece 15 by a plurality of screws 47, which threadingly engage a corresponding number of internally-threaded supports 49 integrally formed on the rear surface of front wall 19. Back piece 17 is shaped to define an inset handle 50, which facilitates carrying window fan 11. Back piece 17 is also shaped to define a pair of integrally formed grilles 51-1 and 51-2, through which air is either drawn or exhausted in the manner discussed below, and a plurality of openings 53-1 through 53-4, into which are mounted a corresponding number of locking assemblies 55-1 through 55-4 in the manner to be described below.

Each one of side extensions 18 is a multi-part assembly made of plastic which is attached to and which extends out from an opening on either end of front piece 15. As will be seen below, side extensions 18 permit fan 11 to be mounted in window openings of varying dimensions. For example, in the present embodiment, extensions 18 permit fan 11 to be mounted in window openings varying from 24 inches to 38 inches either in width (as in the case of double-hung windows) or in height (as in the case of vertical slider windows).

Each extension 18 includes a pair of outer guides 61-1 and 61-2. The top surface of guide 61-1 and the bottom surface of guide 61-2 have inscribed thereon respective sets of rulered markings 63. Each set of rulered markings 63 begins at the outer end of its respective guide 61 and continues inwardly, the markings being numbered 25 to 38 and being spaced at one-half inch intervals. As will be seen below, markings 63 can be used to position fan 11 in the center of a window opening.

A plurality of projections 64 are integrally formed in two parallel rows on the inner top and inner bottom surfaces of guides 61-1 and 61-2, respectively, for the purpose of engaging complementary parts of locking assemblies 55 in the manner to be described below.

An inner panel 65, an intermediate panel 67, and an outer panel 69 are telescopically mounted within guides 61-1 and 61-2, the three panels being separated by the two rows of projections 64. A pair of L-shaped stops 71 are integrally formed on the inner end of inner panel 65 to engage the inner surface of side wall 25. The outer edge of outer panel 69 is sized and shaped to fit within the side railings of a double-hung window frame or within the top and bottom railings of a vertical slider window frame.

Figure 2:
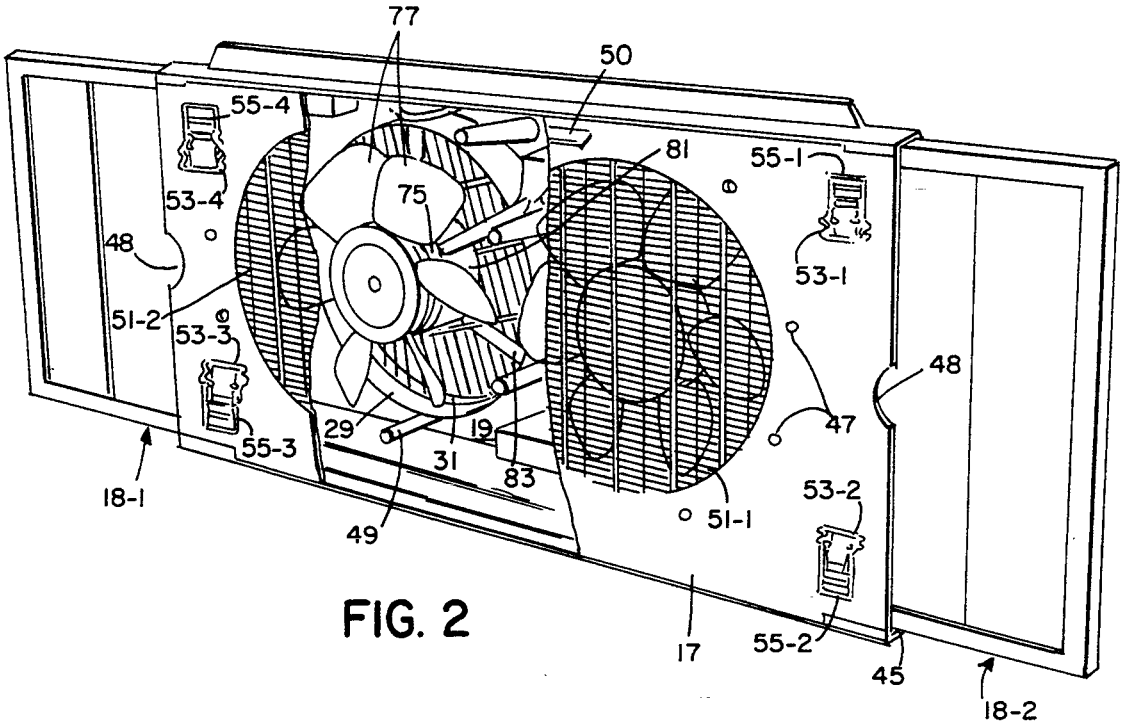
FIG. 2 is a rear perspective view, partly broken away, of the window fan shown in FIG. 1.

The ends of front piece 15 and back piece 17 include arcuate recessed portions 48 which facilitate access to side extensions 18-1 and 18-2 (see FIGS. 1 and 2).

Window fan 11 also includes a pair of fan motor units, which are mounted within the cavity defined by front piece 15. Each fan motor unit includes a fan motor 75 and a set of fan blades 77, fan blades 77 being rotatably mounted on the shaft of fan motor 75. Electric power to fan motors 75 is supplied through wires (not shown) connected to power switch 43, which in turn is connected to a power cord 79 adapted for insertion into an electrical outlet. In addition, each fan motor 75 is electrically connected through wires (not shown) to a corresponding intake/exhaust switch 37, which independently controls the direction of rotation of its respective set of fan blades 77. Consequently, both sets of blades may be set in either the intake or exhaust positions (for increased blowing in either the intake or exhaust directions), or one set of blades may be set in the intake position with the other set of blades set in the exhaust position (to effect a better circulation of air by simultaneously bringing fresh air in and directing stale air out).

Each fan motor 75 is fixedly mounted within a casing 81, which has a plurality of integrally formed supports 83 radially extending outwardly therefrom. The outer ends of supports 83 are integrally formed on cylindrical walls 29 in such a way as to hold casings 81 centered therewithin. Preferably, the wires connecting motor 75 to switches 37 and 43 are attached to or are mounted within one or more of supports 83 to prevent their coming into contact with fan blades 77.

Figure 6A:
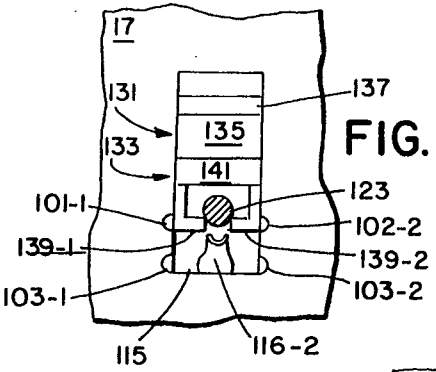
FIGS. 6(*a*) and 6(*b*) are enlarged, fragmentary, plan views taken from the rear of the back piece of the housing shown in FIG. 2, showing one of the locking assemblies mounted in its respective opening In the open and locked positions, respectively.
Figure 6B:
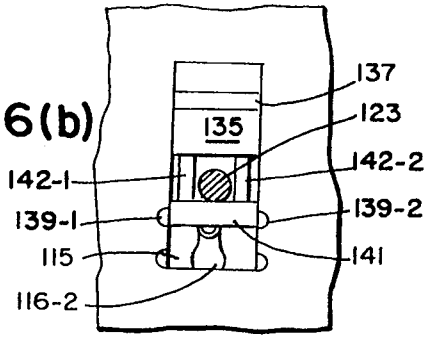
Figure 5:
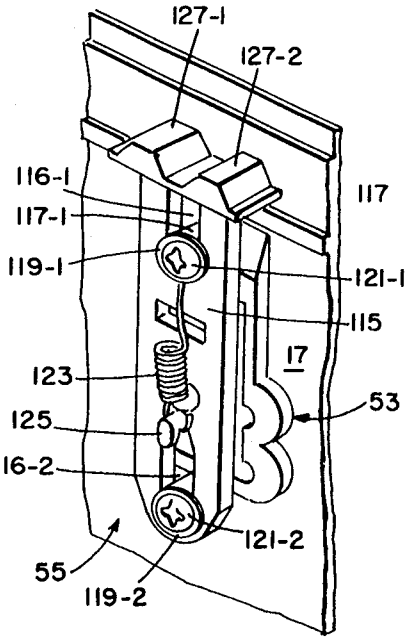
FIG. 5 is an enlarged, fragmentary, perspective view taken from the front of the back piece of the housing shown in FIG. 2, showing one of the locking assemblies mounted in its respective opening.
Figure 3B:
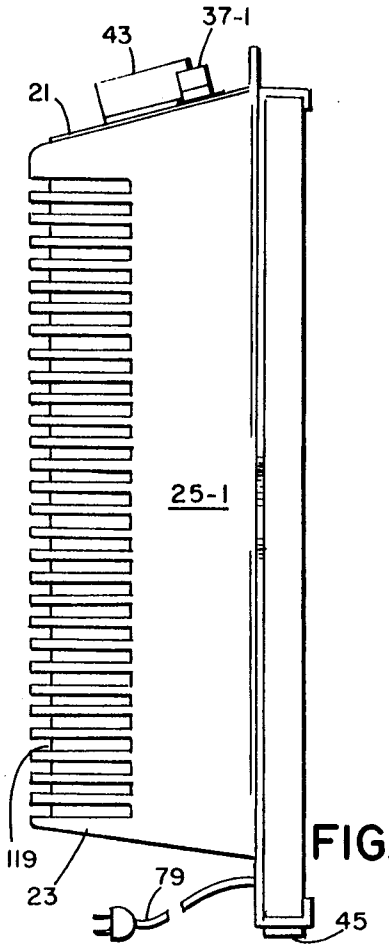
Figure 4:
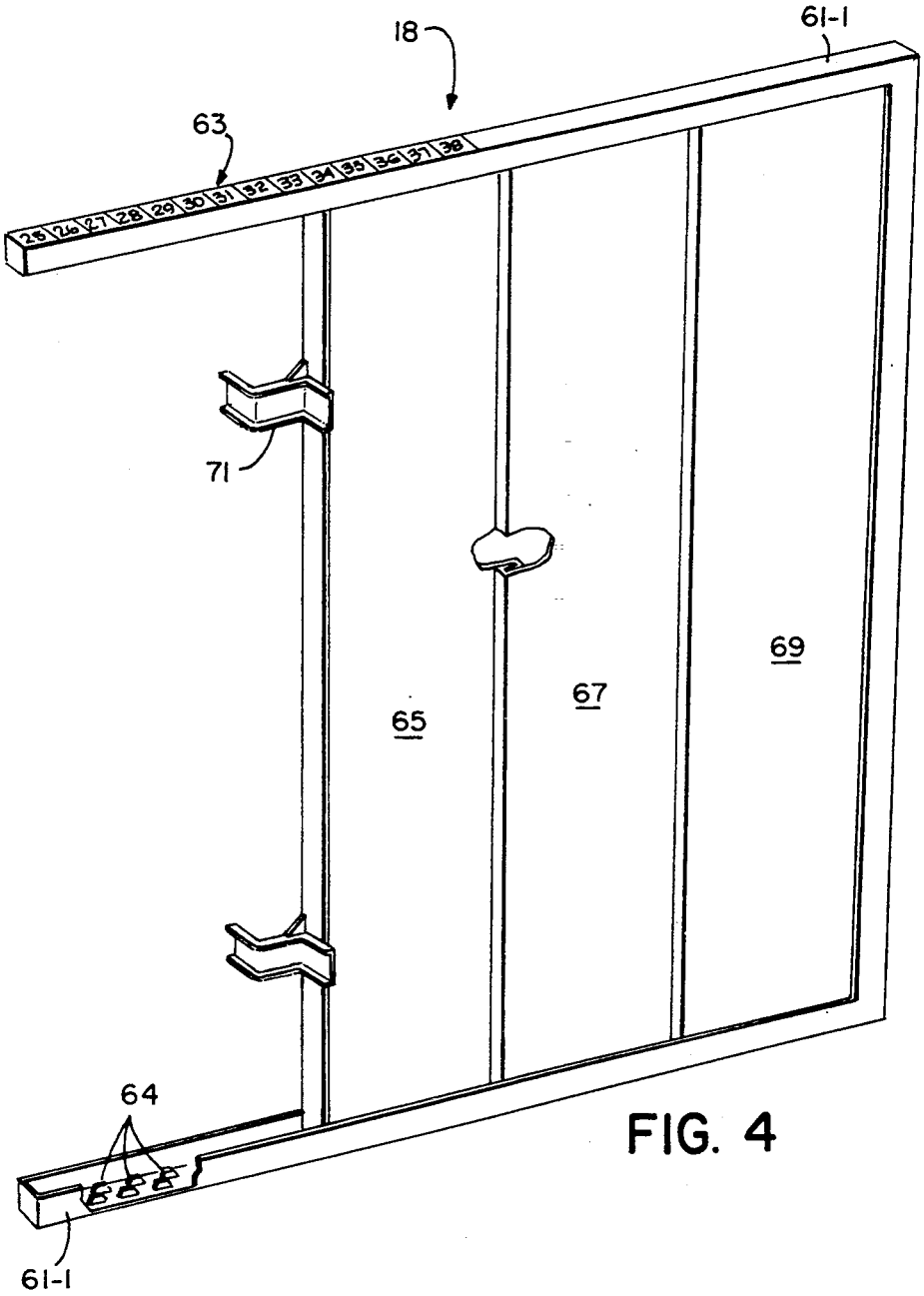
FIG. 4 is an enlarged, rear perspective view, broken away in part, of one of the side extensions shown in FIG. 1.

Referring now to FIGS. 5 and 6, opening 53 and locking assembly 55 are shown in greater detail.

Opening 53, which is generally rectangular in shape, includes a first set of lateral extensions 101-1 and 101-2 and a second set of lateral extensions 103-1 and 103-2, extensions 101 being disposed approximately three-quarters of the distance from the top of opening 53 and extensions 103 being disposed at the bottom of opening 53. (Extensions 103 are not involved in the operation of locking assemblies 55 and will not be discussed hereafter.)

Assembly 55 includes a switch having a front portion 113. Front portion 113 includes a longitudinal section 115 and a transverse portion 117 integrally formed thereon. Longitudinal portion 115, which has a pair of oval-shaped slots 116-1 and 116-2, is slidably mounted on a pair of internally threaded posts 117-1 and 117-2, which are integrally formed on the front surface of back piece 17, and is kept in place by washers 119-1 and 119-2 and screws 121-1 and 122-2. A spring 123 is connected at one end to post 117-1 and at the other end to an L-shaped post 125 integrally formed on the front of portion 115.

Transverse portion 117 has formed on its upper surface a pair of arcuate projections 127-1 and 127-2. For reasons to become apparent below, projections 127-1 and 127-2 are sized, shaped, and spaced to be mateable with projections 64 of guides 61.

The switch also has a rear portion which extends partially out through opening 53 and which includes an upper portion 131 and a lower portion 133. Upper portion 131, which is integrally formed on the rear surface of longitudinal portion 115, includes a rectangular body 135 having an integrally formed ridge 137. Ridge 137 provides a handle whereby one may keep body 135 stationary against the top of opening 53 when one wants to displace lower portion 133 relative to upper portion 131. Upper portion 131 also includes a pair of inwardly-biased, L-shaped legs 139-1 and 139-2, which extend downwardly from body 135. As will be seen below, under certain circumstances, legs 139 can be spread apart into lateral extensions 101.

Lower portion 133 includes a narrow, rearwardly extending rectangular body 141. A pair of inwardly-biased, L-shaped legs 142-1 and 142-2 are Integrally formed on body 141. Legs 142 extend upwardly into body 135 and, in the absence of a force displacing body 141 relative to body 135, engage a tab (not shown) integrally formed within body 135. When a sufficient displacing force is applied to body 141, legs 142 become disengaged from the tab.

To switch assembly 55 from the open position to the locked position, body 135 is held against the top of opening 53 and body 141 is pulled downwardly until legs 139 are spread apart into extensions 101 (see FIG. 6(*b*)). With legs 139 thus inserted into extensions 101, the switch cannot slide down through opening 53 when pressure is applied to projections 127. Consequently, because projections 127 are typically disposed on either side of projections 64, when assembly is thus locked, movement of extension 18 in either the extending or compressing directions is prevented.

To switch assembly 55 from the locked position to the open position, body 141 is pushed towards the top of opening 53 until it comes into contact with the bottom of body 135 (see FIG. 6 (*a*)). With body 141 thus pushed upwards, legs 139 no longer extend into extensions 101 and the switch can be pushed down through opening 53 by applying downward pressure on projections 127, e.g. by pulling projections 64 across projections 127. Consequently, projections 127 will not prevent extension 18 from being extended or compressed.

It should be noted, however, that even when assembly 55 is in the open position, the pressure exerted by projections 127 against projections 64 is sufficient to provide a ratchet-type lock which protects extensions 18 against inadvertent extensions or compressions.

Figure 7:
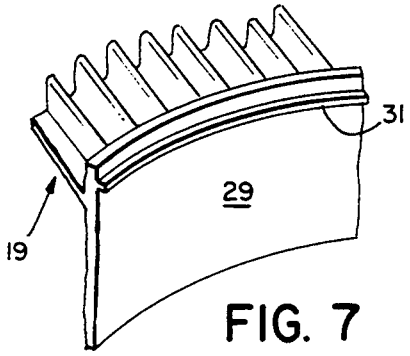
FIG. 7 is an enlarged, fragmentary, perspective view of one of the cylindrical walls into which one of the louver grilles shown in FIG. 1 is snap-locked mounted.
Figure 8:
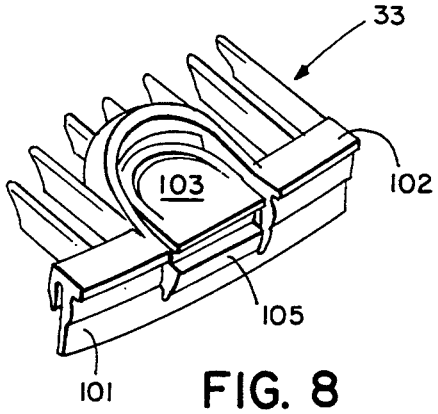
FIG. 8 is an enlarged, fragmentary, perspective view of one of the louver grilles shown in FIG. 1.
Figure 3A:
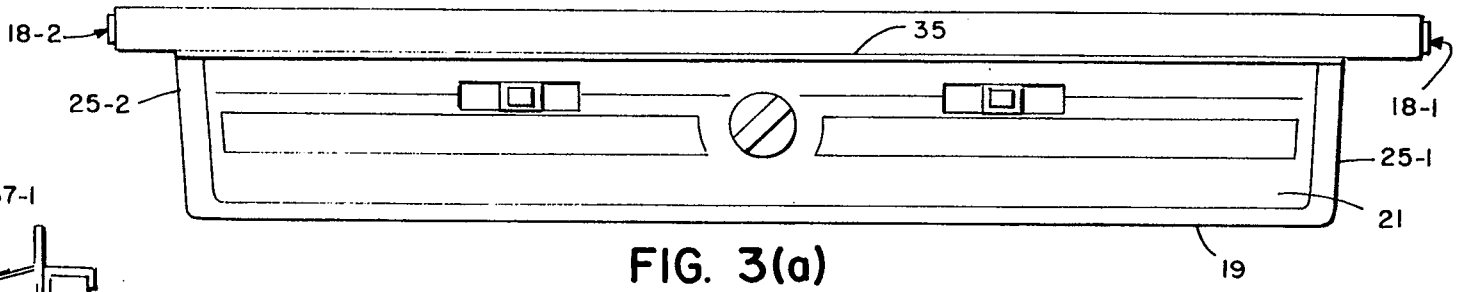
FIGS. 3(*a*) and 3(*b*) are top and right side views, respectively, of the window fan shown in FIG. 1.

Referring now to FIGS. 7 and 8, the constructions of cylindrical wall 29 and louver grille 33 are shown in greater detail to illustrate the manner in which grille 33 can be snap-locked into wall 29. Grille 33, which is a unitary structure, includes a circular rim 101 having a radially extending shelf 102. Shelf 102 is sized and shaped to rest upon shelf 31 of cylindrical wall 29. Rim 101 also includes a pair of diametrically disposed, outwardly-biased, L-shaped tabs 103. A projection 105, which extends outwardly below shelf 31 and thereby serves to snap-lock grille 33 to wall 29, is formed on the side of each tab 103. Depression of tab 103 causes projection 105 to be moved inwardly and out of contact with shelf 31, thereby permitting grille 33 to be removed from wall 29.

Figure 9:
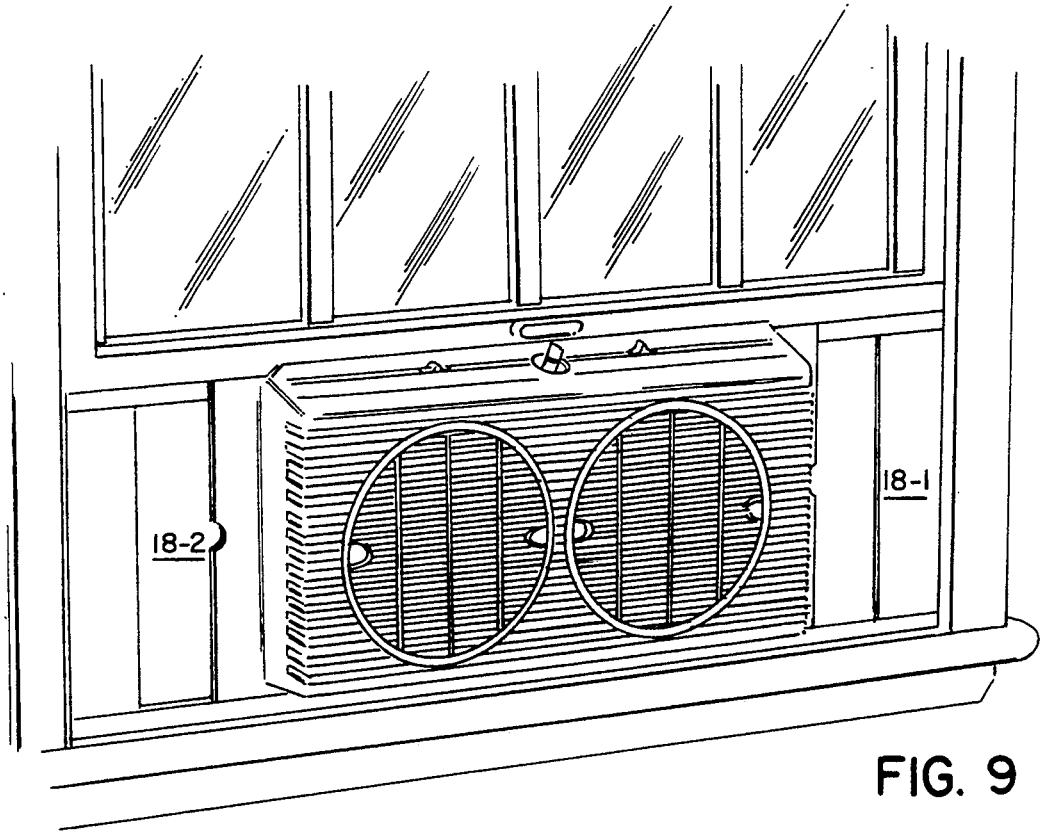
FIG. 9 is a front perspective view showing the window fan of FIG. 1 mounted in a double-hung window.

To mount window fan 11 in a double-hung window frame as seen in FIG. 9, one first opens the window and determines the width of the window frame, i.e., the distance between the left and right railings. Next, with locking assemblies 55-1 through 55-4 in the open position, one of the side extensions 18, for example extension 18-1, is extended until the highest number visible on markings 63 matches the width of the window frame. (For example, if the width of the window frame is determined to be 30 inches, extension 18-1 is extended until the number 30 is visible on its outer guides 61.) Extension 18-1 thus extended, is then locked at this length by placing locking assemblies 55-1 and 55-2 in the locking position. Next, the paper backing from foam-rubber strip 45 is removed, the outer end of extension 18-1 is inserted into the right railing of the window, and strip 45 is pressed against the top of the window sill. The window is then closed on top of fan 11 so that the bottom edge of the window rests behind lip 35 of housing 13. Finally, extension 18-1 is extended until its outer edge slides into the left railing of the window. (Where the width of the window frame is 30 inches, extension 18-2 will be extended until the number 30 is visible on its outer guides 61.) Fan 11 is now securely mounted and centered within the window opening.

Figure 10:
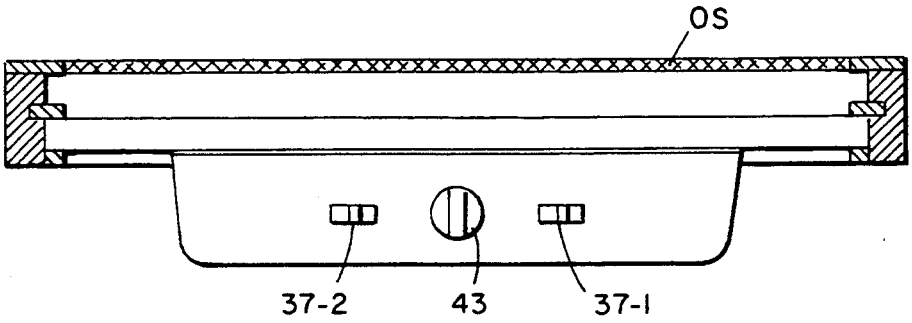
FIG. 10 is a simplified top view showing the window fan of FIG. 1 mounted in a double-hung window having an outer screen.

Referring now to FIG. 10, there can be seen how the construction of window fan 11, in particular the substantially flat shape of back piece 17 and the rearward placement of extensions 18 relative to the remainder of housing 13, permits its mounting in a window having an outer screen OS without requiring outer screen OS to be removed. As can easily be appreciated, this feature is highly desirable since outer screen OS prevents insects and similarly sized items from entering the room in which the fan is mounted. (It is to be understood that while window fan 11 is shown mounted in a double-hung window, the foregoing comments also apply to the situation discussed below where fan 11 is mounted in a vertical slider window.)

Figure 11:
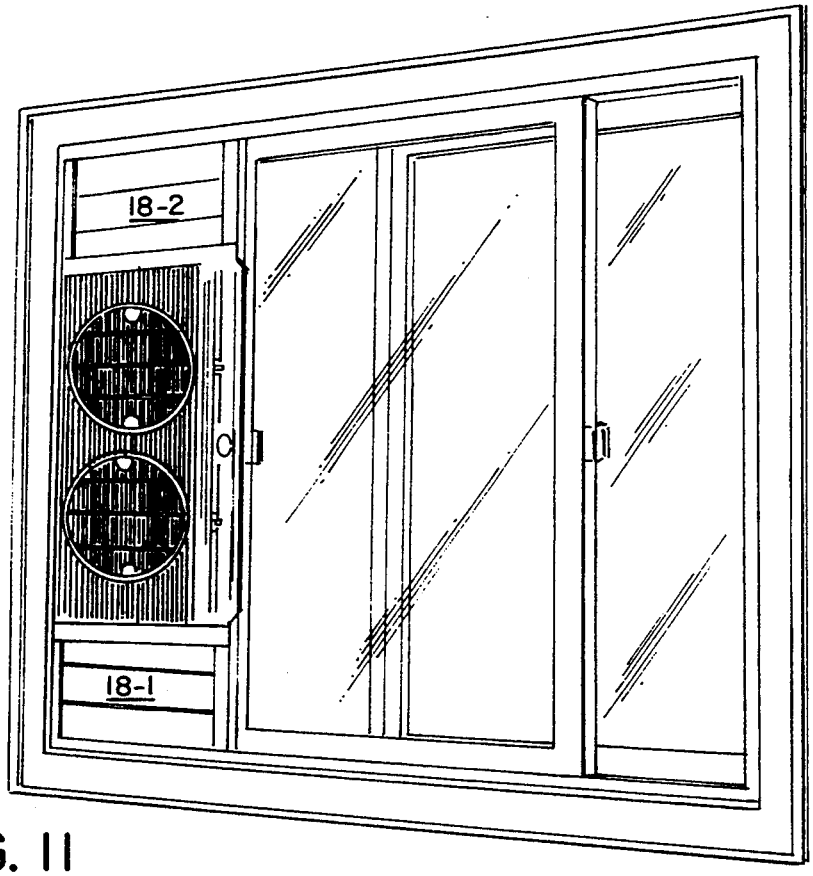
FIG. 11 is a front perspective view showing the window fan of FIG. 1 mounted in a vertical slider window.

The procedure for mounting window fan 11 in a vertical slider window frame as seen in FIG. 11 is analogous to the procedure discussed above for its mounting in a double-hung window frame. First, the height of the window frame is ascertained, i.e., the distance between the top and bottom railings. Next, with locking assemblies 55-1 through 55-4 in the open position, extension 18-1 is extended until the highest number visible on markings 63 matches the height of the window frame. (If the vertical slider window were to open from the right, instead of the left as shown, extension 18-2, not extension 18-1, would be extended.) Extension 18-1, thus extended, is then locked by placing locking assemblies 55-1 and 55-2 in the locking position. The outer end of extension 18-1 is then inserted into the bottom railing of the window, and the bottom of back piece 17 is placed against the side of the window opening. The window is then closed so that the side edge of the window rests behind lip 35 of housing 13. Finally, extension 18-2 is extended until its outer edge slides into the top railing of the window. Fan 11 is now securely mounted and centered within the window opening. There is no need to lock extension 18-1 as it will stay extended because of its ratchet-type mounting.

In another embodiment (not shown), the window fan includes adapters which are removably mounted on the outer edges of the flanking extenders so that the extenders will fit inside window railings of any size.

In still another embodiment (not shown), the window fan includes a pair of removable feet which attach to the bottom of the rear portion of the housing to permit the fan to be used as a floor fan.

The embodiments of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A window fan comprising:

a) a housing having at least one air flow opening adapted to communicate with the space inside of a window, at least one air flow opening adapted to communicate with the space outside of a window, and an adjustably extendable side extension, said adjustably extendable side extension comprising a first outer guide and a second outer guide, said first outer guide having formed on its inner surface at least one row of projections, and a plurality of telescoping panels, said telescoping panels being disposed between said pair of outer guides on opposite sides of said at least one row of projections;

b) a locking assembly mounted on said housing, said locking assembly including means for engaging the projections on said first outer guide in a ratchet-type fashion, permitting movement thereof upon the application thereto of a substantial force; and c) at least one fan unit mounted inside said housing.

2. The window fan as claimed in claim 1 wherein said engaging means includes a slidably mounted switch, said slidably mounted switch having a transverse portion engageable with the projections on said first outer guide, and a spring for biasing said slidably mounted switch so that said transverse portion engages said projections.

3. The window fan of claim 1 wherein said at least one air flow opening adapted to communicate with the space inside of a window is defined by a wall having a peripherally extending shelf and said window fan further includes a grille having a plurality of louvers and having an outwardly biasing integrally formed spring tab adapted to engage said peripherally extending shelf in such a way as to emit said grille to be removably snap-locked into said at least one air flow opening adapted to communicate with the space inside of a window.

4. A window fan comprising:

a housing having at least one air flow opening adapted to communicate with the space inside of a window, at least one air flow opening adapted to communicate with the space outside of a window, and an adjustably extendable side extension, said adjustably extendable side extension comprising a first outer guide and a second outer guide, said first outer guide having formed on its inner surface at least one row of projections, and a plurality of telescoping panels, said telescoping panels being disposed between said pair of outer guides on opposite sides of said at least one row of projections;

b) a locking assembly mounted on said housing, said locking assembly having means for engaging the projections on said first outer guide and being movable between a first position in which said engaging means engages the projections in a ratchet-type fashion, permitting movement of the outer guide upon the application thereto of a substantial force, and a second position in which said engaging means engages the projections in a locking fashion, preventing movement of the outer guide; and c) at least one fan unit mounted inside said housing.

5. A window fan comprising:

a. a housing having a pair of air flow openings adapted to communicate with the space inside of a window, at least one air flow opening adapted to communicate with the space outside of a window, and an adjustably extendable side extension, said adjustably extendable side extension comprising a first outer guide and a second outer guide, said first outer guide having formed on its inner surface at least one row of projections, and a plurality of telescoping panels, said telescoping panels being disposed between said pair of outer guides on opposite sides of said at least one row of projections;

b. a locking assembly mounted on said housing, said locking assembly including means for engaging the projections on said first outer guide in a ratchet-type fashion, permitting movement thereof upon the application thereto of a substantial force; and c. a pair of fan units mounted inside said housing, one of said fan units being used to move air through one of said air flow openings adapted to communicate with the space inside of a window, the other of said fan units being used to move air through the other of said air flow openings adapted to communicate with the space inside of a window, each of said pair of fan units comprising an electrically reversible fan motor and a set of an blades rotatably mounted on said electrically reversible fan motor;

d. a single power switch movable between an open position in which neither of said fan units receives electricity from a power source and one or more closed positions in which both of said fan units receive electricity from a power source; and e. a pair of intake/exhaust switches, one of said pair of intake/exhaust switches controlling the direction of rotation of one of said pair of electrically reversible fan motors, the other of said pair of intake/exhaust switches independently controlling the direction of rotation of the other of said pair of electrically reversible fan motors.

* * * * *